US005371439A

United States Patent [19]

Griffin

[11] Patent Number: 5,371,439

[45] Date of Patent: Dec. 6, 1994

[54] ELECTRONIC BALLAST WITH LAMP POWER REGULATION AND BROWNOUT ACCOMMODATION

[75] Inventor: Raymond T. Griffin, Plano, Tex.

[73] Assignee: The Genlyte Group Incorporated, Secaucus, N.J.

[21] Appl. No.: 50,552

[22] Filed: Apr. 20, 1993

[51] Int. Cl.[5] ..... H05B 37/02

[52] U.S. Cl. ..... 315/209 R; 315/194; 315/247; 315/307; 315/308; 315/291; 315/DIG. 5; 315/DIG. 7

[58] Field of Search ..... 315/209 R, 307, DIG. 5, 315/DIG. 7, 194, 247, 308, 291

[56] References Cited

U.S. PATENT DOCUMENTS 4,234,822 11/1980 Garrison et al. ..... 315/209 R
4,251,752 2/1981 Stolz ..... 315/206
4,277,728 7/1981 Stevens ..... 315/307
4,323,824 4/1982 Roche et al. ..... 315/289
4,370,600 1/1983 Zansky ..... 315/244
4,572,988 2/1986 Handler et al. ..... 315/209 R
4,700,113 10/1987 Stupp et al. ..... 315/224
4,952,849 8/1990 Fellows et al. ..... 315/307
5,111,118 5/1992 Fellows et al. ..... 315/307
5,122,712 6/1992 Hirschmann ..... 315/106
5,144,205 9/1992 Motto et al. ..... 315/244

*Primary Examiner*—Robert J. Pascal
*Assistant Examiner*—Reginald A. Ratliff
*Attorney, Agent, or Firm*—Dennis T. Griggs

[57] ABSTRACT

An electronic ballast for starting gas discharge lamps provides lamp power regulation within a predetermined range, but allows power regulation to drop out in response to load shedding conditions.

6 Claims, 3 Drawing Sheets

ELECTRONIC BALLAST WITH LAMP POWER REGULATION AND BROWNOUT ACCOMMODATION

FIELD OF INVENTION

This invention relates generally to electronic ballasts, and in particular to an electronic ballast circuit which regulates lamp power over a predetermined range of input voltage and thereafter accommodates brownout or load shedding conditions.

BACKGROUND OF THE INVENTION

Gas discharge lamps such as fluorescent lamps require a higher than normal operating voltage to be applied for starting so that the gas within the lamp ionizes. Traditionally, iron core and coil ballasts operating at a frequency of 50–60 Hz have been employed to generate the higher than normal operating voltage. Iron core and coil ballasts, however, are characterized by a poor power factor, heavy weight, and large physical size. Additionally, they generate harmonics, radiate an audible buzz, and produce a bothersome light flicker.

Solid-state high frequency electronic ballasts have been employed which use ferrite core transformers, improve the power factor, are smaller in size and less in weight, and produce virtually no audible noise. In these prior art ballasts, line voltage (50–60 Hz AC) is rectified to a DC voltage then inverted to an AC voltage by a power inverter to drive the lamp at a much higher frequency, typically in the range of 10–50 KHz.

In periods of peak electrical demand such as in the summer months, the utility companies have a difficult time meeting the needs of all their customers. One technique of sustaining service during peak demand is to "load-shed" non-essential loads. Another method is to reduce the service voltage, referred to as a "brownout". This typically involves lowering the nominal service voltage from 120 VAC to 115 VAC or slightly lower resulting in a 5%–10% savings in power. A limitation with the brownout technique is that some electrical equipment compensates for the lower voltage by drawing more current thus negating any advantage to the utility company. For example, the solid state ballast utilizes a switched mode power inverter having feedback for keeping the power constant. It will be appreciated that such solid state ballasts hinder the utility companies' attempt to shed loads.

Another limitation on the use of switched mode power inverter type ballasts is that they do not work properly with phase control dimmer switches, commonly used within incandescent lamps. This is so for the same reasons set forth above.

DESCRIPTION OF THE PRIOR ART

One known dimming device for fluorescent lamps is described in U.S. Pat. No. 4,370,600 in which the inductance of auxiliary windings is employed to maintain a relatively constant voltage across the lamp filaments throughout the dimming range. A high frequency power supply including a resonant bridge inverter allows dimming of the fluorescent lamp by varying the pulse width of a pulse width modulated drive. It can be seen that this method requires auxiliary windings and substantial magnetic design to maintain filament voltage constant as the fluorescent lamp is dimmed.

Another dimming device is described in U.S. Pat. No. 4,251,752 wherein the input of a loop amplifier is reduced to force a reduction in power from the AC line. The .duty cycle of a resonant inverter is also reduced to prevent the output voltage from falling below the peak alternating current line voltage. Dimming the lamp is accomplished by varying the shunt resistance so that the sense voltage to the input of the loop amplifier is reduced. Since the feedback control operates to force the sense voltage and current to zero, the current drawn by the ballast system is forced to decrease proportionally. Consequently, the power consumed decreases. This type of dimming circuit requires a separate variable resistance, either passive or active, making it incompatible with existing phase control type dimmer switches.

Accordingly, it will be appreciated that an electronic ballast is needed which provides constant lamp power over a predetermined input voltage range but which accommodates load shedding and conventional phase control dimmer switches.

SUMMARY OF THE INVENTION

The present invention provides an electronic ballast having constant power output over a predetermined range of input: voltage but which accommodates brownout or load shedding conditions, as well as operation of standard phase control dimming switches.

The electronic ballast disclosed employs switched mode control circuitry and a high frequency power inverter for providing substantially constant power output over a predetermined input voltage range and having a power factor substantially near unity. Means for logically "OR"ing a second operating condition are provided for closed loop or open loop control of the boost regulator.

One advantage of the present invention is that it provides constant lamp power regulation over a predetermined range of input voltage, but allows the power regulation to drop out in response to brownout or load shedding conditions.

Another advantage of the present invention is constant power regulation within a predetermined range while providing dimmer operation with standard phase control dimming switches of the type typically used with incandescent lamps.

These and various other advantages and features of novelty which characterize the invention are pointed out with particularity in the claims. However, for a better understanding of the invention, its advantages, and the objects obtained by its use, reference should be made to the drawings which form a further part hereof, and to the accompanying specification, in which there is illustrated and described a preferred embodiment in accordance with the present invention.

BRIEF DESCRIPTION OF THE DRAWINGS

Referring now to the drawings in which like reference numerals and letters indicate corresponding elements throughout the several views.

DETAILED DESCRIPTION OF THE PREFERRED EMBODIMENT

Figure 1:
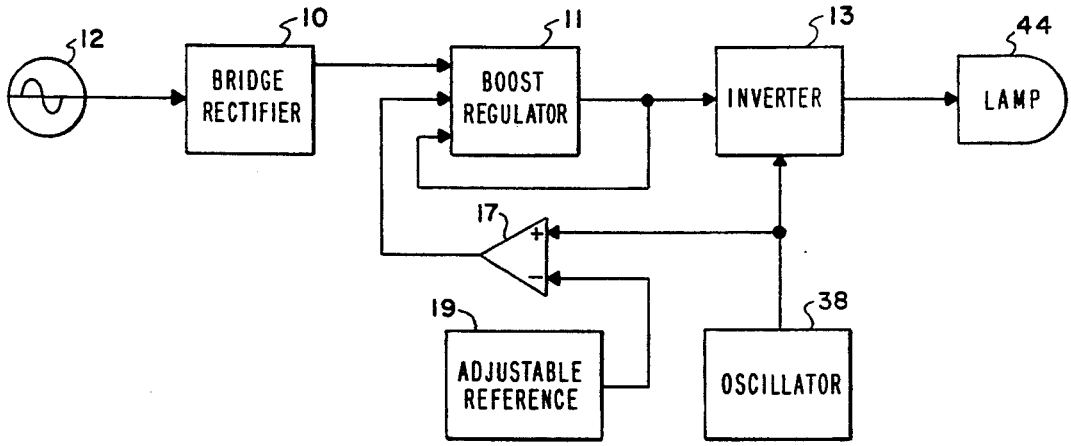
FIG. 1 is a general block diagram of an electronic ballast practiced in accordance with the principles of the present invention.

In the following description of the preferred embodiment, reference is made to the accompanying drawings which form a part hereof, and in which is shown by way of illustration a specific embodiment in which the invention may be practiced. It is to be understood that other embodiments may be utilized and structural changes may be made without departing from the scope of the present invention. The present invention resides primarily in a novel combination of conventional electrical circuits, and not in a particular detailed configuration thereof. The structure, control, and arrangement of these conventional circuits have been illustrated in the drawings by readily understandable block and schematic diagrams which show only those specific details which are pertinent to the present invention. The block diagrams are primarily intended to illustrate the major circuit components in a convenient functional grouping, wherein the present invention may be more readily understood.

Referring now to FIG. 1, AC line voltage 12 is impressed across the input of a bridge rectifier 10 in an electronic ballast. A boost regulator 11 has a first input coupled to the bridge rectifier output, a second input coupled to the output of the boost regulator 11 and a third input coupled to the output of a comparator 17. The comparator 17 has a first input coupled to the oscillator 38 and a second input coupled to an adjustable reference 19. The boost regulator 11 may be operated in an open or a closed loop fashion for stepping up the DC voltage from bridge rectifier 10 as described in detail below. The output of the boost regulator 11 is coupled to a power inverter 13 which chops the stepped up DC voltage at a high frequency. The output of the inverter 13 is preferably transformed by an L-C circuit (FIG. 2) to provide impedance matching before application to lamp 44.

Figure 2:
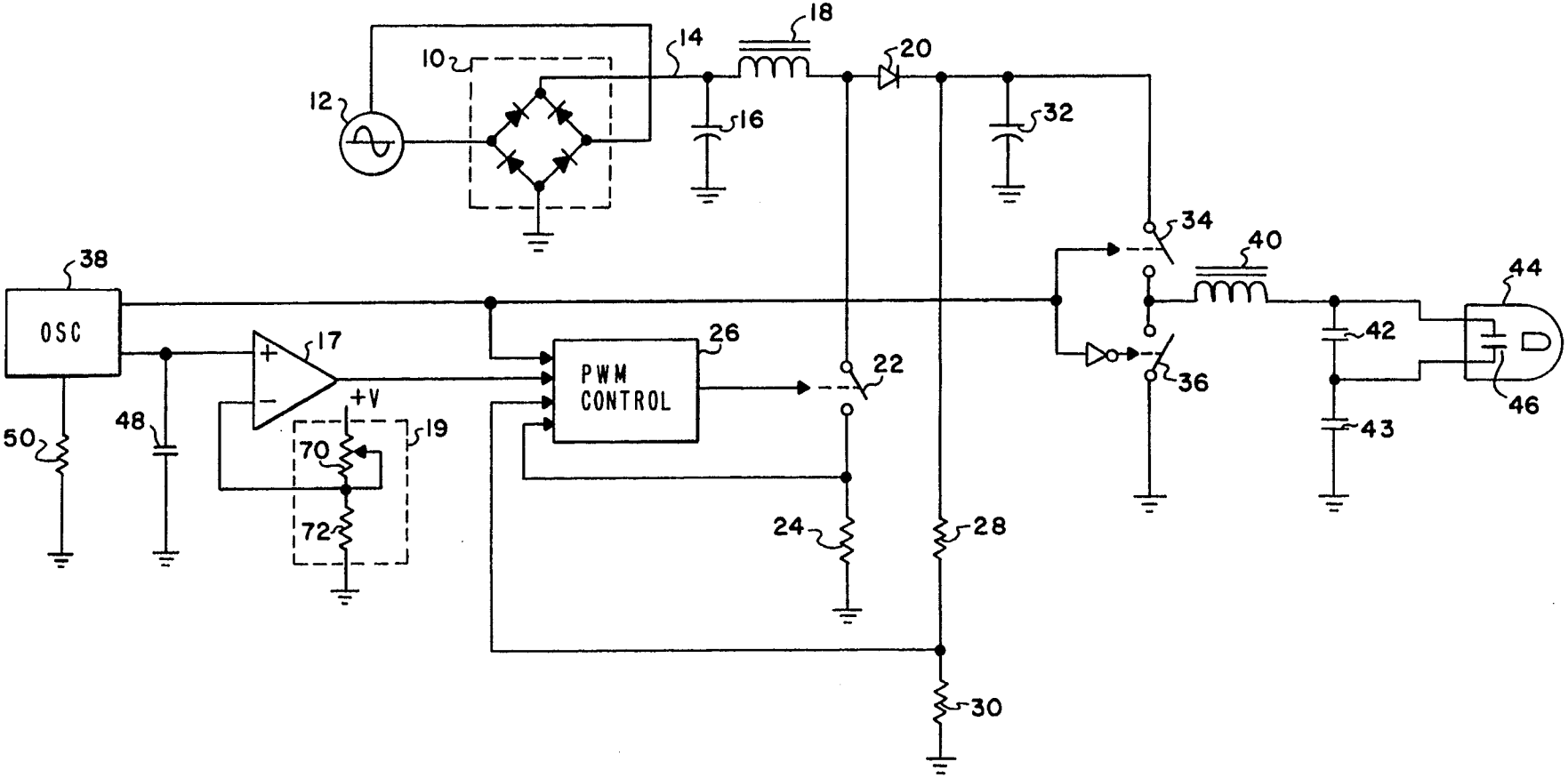
FIG. 2 is a schematic of a constant power electronic ballast incorporating brownout and dimming accommodations practiced in accordance with the principles of the present invention.

Reference is now made to FIG. 2 which depicts a schematic of an electronic ballast practiced in accordance with the principles of the present invention. The bridge rectifier 10 has impressed on it AC voltage 12 of a frequency typically between 50–60 Hz and produces a DC output voltage on line 14. Filter capacitor 16 provides high frequency filtering of the DC output voltage on line 14 as well as for any high frequency noise produced by oscillator 38. An inductor 18 has a first end coupled to the rectified DC voltage on line 14 and a second end coupled to the junction of the anode Of diode 20 and switch 22. Capacitor 16 charges inductor 18 through closed switch 22 and a current sense resistor 24. The current sense resistor 24 is of ample wattage rating to withstand the high current flow through the switch 22. The opening and closing of switch 22 is controlled by a pulse width modulation (PWM) control circuit 26 described in detail below. In the preferred embodiment, the switch 22 is a field effect transistor (FET) with ample voltage and current ratings to withstand the flyback operation of inductor 18.

Collectively, inductor 18, switch 22, resistor 24, and PWM control circuit 26 cooperate together as the boost or step-up regulator 11. A boost voltage is impressed across capacitor 32 through diode 20 which is proportional to the sum of the voltage across capacitor 16 and the voltage produced by the inductance (L) of inductor 18 multiplied by the change in current (di/dt) through it. The boost regulator 11 operates in a discontinuous flyback mode wherein oscillator 38 via PWM control circuit 26 turns on switch 22 on each clock cycle of oscillator 38 and feedback from resistors 24 and 30 turns it off. When switch 22 is turned on by PWM control circuit 26, the DC voltage on line 14 is impressed across inductor 18, switch 22, and resistor 24. The current ramps up and the inductor 18 stores energy in its core. When switch 22 is turned off by feedback from resistors 24 and 30, the voltage across inductor 18 kicks back to resist the change in current (di/dt). The voltage across capacitor 16 and the voltage produced by the L.di/dt is impressed on capacitor 32 through diode 20. Diode 20 separates inductor 18 and capacitor 32 allowing for the voltage across capacitor 32 to be larger than the voltage impressed at line 14.

Figure 3:
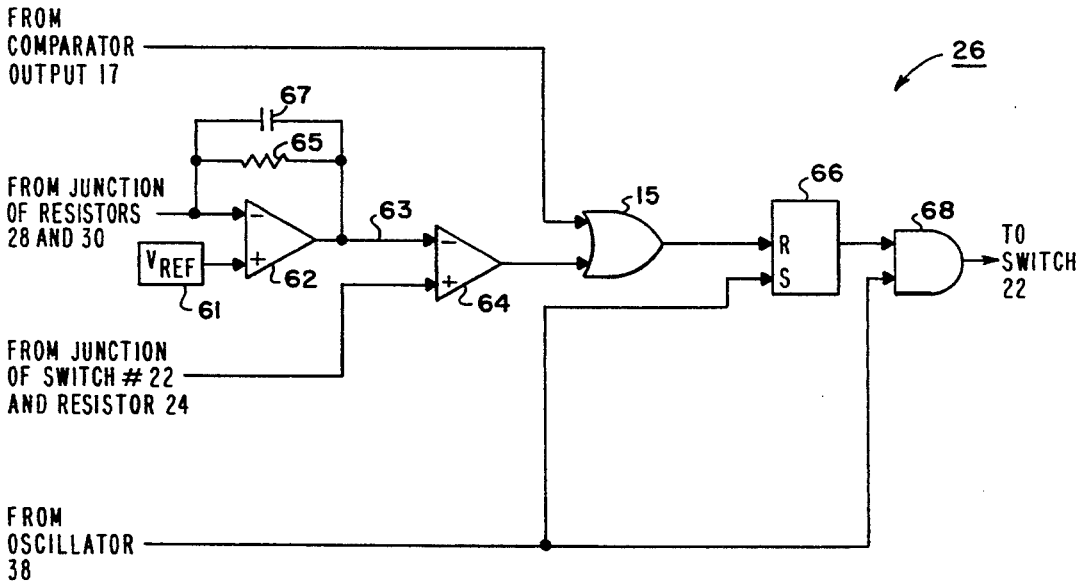
FIG. 3 is a more detailed schematic of the pulse width modulation control circuitry depicted in FIG. 2; and, FIGS. 4A, 4B and 4C illustrate typical waveforms developed by the circuitry of FIGS. 2 and 3.

Resistors 28 and 30 located on the cathode side of diode 20 form a voltage divider providing a second input voltage to PWM control circuit 26. The voltage across resistor 30 is proportional, through voltage division, to the boost voltage across capacitor 32. The feedback voltage to PWM control circuit 26 from resistors 24 and 30 provides current and voltage information respectively so that power delivered through diode 20 to capacitor 32 is maintained constant. The maximum level of peak current through inductor 18 is set by the output 63 cf error amplifier 62 (FIG. 3) which compares the voltage across resistor 30 to the boost voltage to a reference voltage $V_{REF}$ produced by reference generator 61 (FIG. 3). The reference voltage $V_{REF}$ and the ratio of resistors 28 and 30 are preselected so that the desired boost voltage is maintained across capacitor 32.

A pair of series connected, mutually exclusive switches 34 and 36 are coupled between the boost voltage impressed across capacitor 32 and the common ground. Switches 34 and 36 cooperate as a power inverter 13 for chopping the DC boost voltage into a square wave having a frequency the same as the oscillator 38. Referring to FIG. 2, the oscillator 38 oscillates at a frequency proportional to the capacitance of capacitor 48 and the resistance of resistor 50. Many expedients are known for the oscillator 38, the exact configuration not being necessary for the understanding of the present invention. The oscillator 38 may be part of or included in PWM control circuitry 26.

Switch 34 has its first end coupled to the junction of capacitor 32 and the cathode of diode 20. The second end of switch 34 is coupled to the common junction of the first end of switch 36 and the first end of inductor 40. The second end of switch 36 is coupled to the common ground. In the preferred embodiment, switches 34 and 36 are complementary field effect transistors (FETS) with ample voltage and current ratings to withstand the reactive loads. Those skilled in the art will recognize other expedients for switches 34 and 36 without departing from the scope of the present invention.

Switches 34 and 36 are controlled by oscillator 38 no chop the DC boost voltage developed across capacitor 32 at the frequency of oscillator 38. That is, switches 34 and 36 are opened and closed at opposite times to produce a substantially square wave having an amplitude ranging from boost voltage to common ground and a frequency equal to the oscillator 38. The square wave is impressed across inductor 40 and capacitors 42 and 43. Applicants have found through simulation and experimentation that the preferred chopping frequency for fluorescent lamps ranges from 40–80 KHz.

Inductor 40 and capacitors 42 together with capacitor 46 form an LC circuit which provides a high Q factor and matching impedance for starting the lamp. The low pass filter attenuates harmonic frequencies generated by the switching of switches 34 and 36 and provides a substantially sinusoidal voltage across lamp 44. The lamp 44 may be of the type described in U.S. Pat. No. 4,862,035, herein incorporated by reference. The capacitor 43 provides DC isolation for the lamp circuit.

Comparator 17 has its non-inverting input coupled to the junction of the oscillator 38 and capacitor 48. The inverting input of comparator 17 is coupled to the junction of voltage divider comprised of variable resistor 70 and fixed resistor 72. The output of comparator 68 is coupled into PWM control circuitry 26. The junction of oscillator 38 and capacitor 48 has a sawtooth waveform on it synchronous and of the same frequency as the oscillator 38.

Reference is now made to FIG. 3 which depicts a more detailed view of the PWM control circuit 26 in FIG. 2. It should be understood that FIG. 3 only depicts the preferred embodiment and that other switched mode power PWM converters may be adapted for use as the PWM control circuit 26 without departing from the scope of the present invention. Exemplary, but not exclusive of another PWM control circuit 26 adaptable for use with the present invention, is the UC384-2/UC3844 PWM circuit from the Unitrode Integrated Circuit Corporation of Merrimack, N.H.

Error amplifier 62 has its inverting input coupled to the junction of resistors 28 and 30. It has a resistor 65 and capacitor 67 coupled between the inverting input and its output 63. Its non-inverting input is coupled to reference voltage generator 61. Voltage generator 61 may be a zener diode, voltage divider or other suitable source. The reference voltage ($V_{ref}$) is selected to be a voltage which is proportional to the boost voltage across capacitor 32 multiplied by the ratio of the voltage divider formed by resistors 28 and 30. For example, if $V_{ref}$ is set to 2.5 volts, the boost regulator would regulate the boost voltage across capacitor 32 to a value such that the voltage drop across resistor 30 would be substantially 2.5 volts.

The output 63 of error amplifier 62 is coupled to the inverting input of current sense comparator 64. The non-inverting input of comparator 64 is coupled to the junction of switch 22 and resistor 24. The voltage drop across resistor 24 is proportional to the current flowing through inductor 18 of the boost regulator 11. The output of comparator 64 is coupled to a first input of OR gate 15. A second input to OR gate 15 is coupled to the output of comparator 17. When the voltage drop across resistor 24 equals or exceeds the output 63 of error amplifier 62, comparator 64 trips and resets flip flop 66 through OR gate 15. The output of flip flop 66 provides a first input to AND gate 68 for opening switch 22. Oscillator 38 is coupled to a second input of AND gate 68. AND gate 68 is a protective measure requiring both the oscillator 38 and the output of flip flop 66 be high in order to close switch 22. This feature ensures that if comparator 64 does not reset flip flop 66, then switch 22 will only be on for one-half the duty cycle of oscillator 38. It should be appreciated that other dead time techniques for opening and closing switch 22 may be employed without departing from the scope of the present invention.

The process of closing switch 22 is repeated on subsequent oscillator clock pulses wherein oscillator 38 sets flip flop 66 and comparator 64 resets it when the desired current is through inductor 18 is obtained. In this manner, a closed loop system is maintained to regulate the boost voltage across capacitor 32. The inductor 18 is initially charged on the leading edge of each clock pulse of oscillator 38 until the sensed current equals the output of error amplifier 62. Since the oscillator 38 operates at a frequency many times higher than the AC line frequency, the inductor 18 charges and discharges hundreds of times during each cycle of the AC line. This technique provides that the voltage and current to the lamp 44 are substantially in phase and a power factor of nearly unity is achieved.

As shown in FIG. 3, the output from comparator 64 is coupled to a first input of OR gate 15 and operates as described above. The second input to OR gate 15 is coupled to the output of comparator 17. The additional input from the output of comparator 17 resets the flip flop 66 in the event that the current through the inductor 18 does not rise to a point to do so. By adjusting resistors 70 and 72 (FIG. 2), the PWM control circuitry 26 may be disabled prematurely so that a reduced input voltage will dim the lamp 44.

The above discussion of "short cycling" is best illustrated with reference to FIG. 4A which depicts waveforms from various points from within the circuitry depicted in FIGS. 2 and 3. The non-inverting input of comparator 17 has impressed upon it a sawtooth waveform 75 from oscillator 38 representing capacitor 48 charging and discharging. Dashed line 76 represents a threshold voltage $V_{UNREG}$ which is applied to the inverting input of comparator 17, set in the preferred embodiment by the voltage division of resistors 70 and 72. $V_{UNREG}$ is a reference voltage set so that the present invention falls out of regulation at a preselected boost voltage.

Waveform 78 (FIG. 4B) is the current through inductor 18 represented by the voltage across resistor 24 and which is the input to comparator 64. Waveform 80 (FIG. 4C) represents the output of OR gate 15 or in the alternative, the reset input to flip flop 66. As can be seen in FIG. 4B, waveform 78 ramps up to $V_{REF}$ and triggers comparator 64. The output of comparator 64 is coupled to an input to OR gate 15 which resets flip flop 66. Resetting flip flop 66 opens switch 22 thus causing waveform 78 to fall to zero. It should be understood that comparator 64 resets flip flop 66 via OR gate 15 before oscillator waveform 75 can reach the $V_{UNREG}$ threshold.

Figures 4A, 4B, 4C:
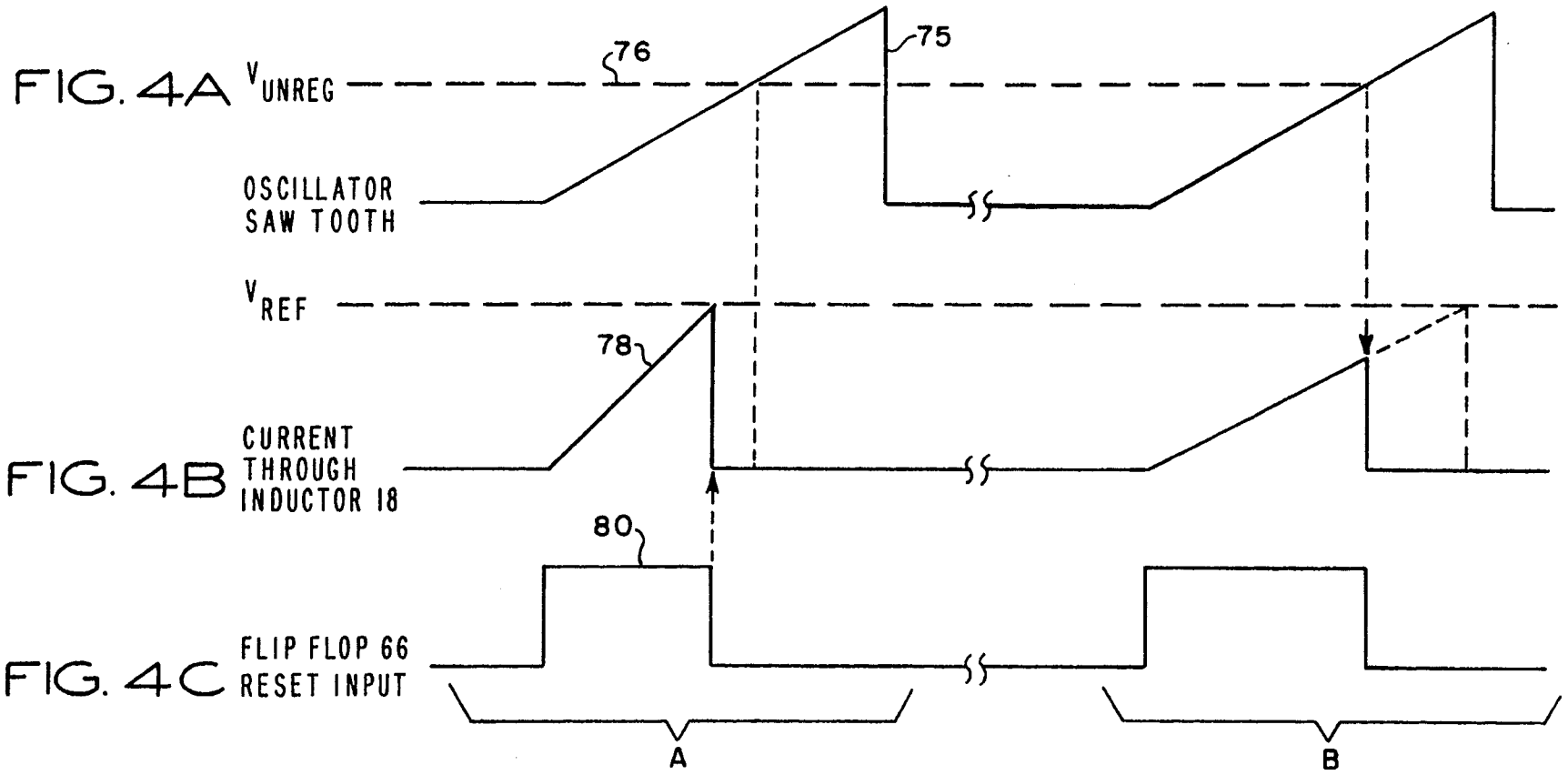

Reference is now made to FIG. 4B which depicts a situation where the boost regulator 11 drops out of regulation. The applied AC voltage 12 is reduced so that current waveform 78 through inductor 18 rises with a more gradual slope. Before comparator 64 can reset flip flop 66, waveform 75 reaches the threshold $V_{UNREG}$. THUS, comparator 17 trips causing the second input to OR gate 15 to go true and to reset flip flop 66. So long as current waveform 78 through inductor 18 reaches a point which trips comparator 64 before such time that waveform 76 reaches $V_{UNREG}$, the electronic ballast maintains constant power output. However, if the input AC voltage 12 is reduced such that current waveform 78 through inductor 18 cannot reach a point to trip comparator 64, then comparator 17 disables switch 22 via flip flop 66. In this manner, a threshold voltage $V_{UNREG}$ can be set so that regulation is maintained for so long as a minimum input AC voltage is applied and will thereafter fall out of regulation.

For example, in the preferred embodiment, $V_{UNREG}$ is set to correspond to a point which is proportional to a line voltage of 108 VAC. Thus, as long as input AC voltage 12 remains 108 VAC or above, the operation as depicted in FIG. 4A applies and constant power output is regulated. If however, the applied AC voltage 12 falls below 108 VAC either through a brownout condition or where a dimmer control switch is used, the PWM control circuitry 26 is short cycled by comparator 17 as depicted in FIG. 4B, that is, waveform 75 reaches $V_{UNREG}$ before the current through resistor 24 (waveform 78) is permitted to build up to the requisite level. The threshold voltage $V_{UNREG}$ may be set at any level corresponding to a point at which the utility company will lower its service voltage in an attempt to shed loads. Alternatively, the threshold voltage may be set so that standard dimmer switches can be used to dim the fluorescent lamp without any noticeable hysteresis in brightness control.

The foregoing description of the preferred embodiment of the invention has been presented for the purposes of illustration and description. It is not intended to be exhaustive or to limit the invention to the precise form disclosed. Modifications and variations are possible in light of the above teachings. It is intended that the scope of the invention be limited not by this detailed description, but rather by the claims appended hereto.

What is claimed is:

1. An electronic ballast comprising:

rectifier means, adapted for connection to a source of AC voltage, for providing a DC output voltage;

a boost regulator having first, second and third inputs, and an output, the first input being coupled to the rectifier means and the second input being coupled to the boost regulator output;

a power inverter having first and second inputs and an output for driving a gas discharge lamp, the first input being coupled to the boost regulator output;

an oscillator having an output coupled to the second input of the power inverter; and a short cycle switching circuit coupled to the boost regulator third input, said short cycle switching circuit having an output and a first input coupled to a reference voltage and a second input coupled to the oscillator output, for terminating the boost regulator in response to the source of AC voltage falling below a predetermined level so that the boost regulator output falls out of regulation.

2. An electronic ballast comprising:

rectifier means, adapted for connection to a source of AC voltage, for providing a DC output voltage;

a boost regulator having first, second, and third inputs, and an output, the first input coupled to the rectifier means and the second input coupled to the boost regulator output;

a power inverter having first and second inputs and an output for driving a gas discharge lamp, the first input coupled to the boost regulator output;

an oscillator having an output coupled to the second input of the power inverter;

short cycle means coupled to the boost regulator third input, said short cycle means having a first input coupled to a reference voltage and a second input coupled to the oscillator output, for terminating the boost regulator in response to the source of AC voltage falling below a predetermined level so that the boost regulator output falls out of regulation; and, a comparator having inverting and noninverting inputs, and an output, the inverting input being coupled to an adjustable threshold reference and the noninverting input being coupled to the oscillator, the oscillator defining a period in which the boost regulator must reach regulation.

3. An electronic ballast comprising:

rectifier means, adapted for connection to a source of AC voltage, for providing a DC output voltage;

a boost regulator having first, second, and third inputs, and an output, the first input coupled to the rectifier means and the second input coupled to the boost regulator output;

a power inverter having first and second inputs and an output for driving a gas discharge lamp, the first input coupled to the boost regulator output;

an oscillator having an output coupled to the second input of the power inverter;

short cycle means coupled to the boost regulator third input, said short cycle means having a first input coupled to a reference voltage and a second input coupled to the oscillator output, for terminating the boost regulator in response to the source of AC voltage falling below a predetermined level so that the boost regulator output falls out of regulation;

said boost regulator including:

an inductor having first and second terminals, the first terminal being coupled to the rectifier means;

a switch having first and second terminals, and a control input, the first end being coupled to the switch second terminal, the resistor second terminal being coupled to a common ground;

a sense resistor having first and second terminals, the first terminal being coupled to the switch second terminal, the resistor second terminal being coupled to a common ground; and, a pulse width modulation circuit, having a first input coupled to the sense resistor first terminal, a second input coupled to the inductor second terminal, and an output coupled to the switch control input.

4. An electronic ballast comprising:

rectifier means, adapted for connection to a source of AC voltage, for providing a DC output voltage;

a boost regulator having first, second, and third inputs, and an output, the first input coupled to the rectifier means and the second input coupled to the boost regulator output;

a power inverter having first and second inputs and an output for driving a gas discharge lamp, the first input coupled to the boost regulator output;

an oscillator having an output coupled to the second input of the power inverter;

short cycle means coupled to the boost regulator third input, said short cycle means having a first input coupled to a reference voltage and a second inputcoupled to the oscillator output, for terminating the boost regulator in response to the source of AC voltage falling below a predetermined level so that the boost regulator output falls out of regulation; and, said pulse width modulation circuit including:

an error amplifier having a noninverting input coupled to a voltage reference, an inverting input coupled to the boost regulator output, and an output for providing an error signal;

a comparator having an inverting input coupled to the error amplifier output, a noninverting input coupled to the sense resistor first end, and an output;

an OR gate having a first end coupled to the comparator output and a second end coupled to the short cycle means, and an output;

a flip flop having a reset input coupled to the OR gate output, set input coupled to the oscillator, and an output; and, an AND gate having a first input coupled to the flip flop output, a second input coupled to the oscillator, and an output coupled to the switch control output.

5. An electronic ballast comprising:

a bridge rectifier having an input adapted for connection to an AC voltage source and having an output for providing a rectified DC voltage;

a boost regulator having an input coupled to the output of the bridge rectifier and an output for boosting the rectified DC voltage;

an oscillator having an output for providing a clock signal;

a power inverter having a power input coupled to the output of the boost regulator, a control input coupled to the oscillator output, and having an output for providing a square wave signal having a frequency of the oscillator and an amplitude substantially that of the boost regulator output; and a comparator having a first input coupled to an adjustable reference, a second input coupled to the oscillator, and an output coupled to the boost regulator, the comparator including means for disabling the boost regulator in response to the oscillator output exceeding the reference voltage.

6. An electronic ballast for starting a gas discharge lamp comprising:

a bridge rectifier having an input adapted for connection to an AC voltage source and having an output for providing rectified DC voltage;

a first capacitor having a first terminal being coupled to the output of the bridge rectifier and a second terminal being coupled to a common ground;

an inductor having a first terminal and a second terminal, the first terminal coupled to the first terminal of the first capacitor and to the output of the bridge rectifier;

a first switch having a first terminal and a second terminal, the first terminal coupled to the second terminal of the inductor;

a first resistor having a first terminal coupled to the second terminal of the first switch and a second terminal coupled to the common ground;

a diode having an anode and a cathode, the anode coupled to the second terminal of the inductor and to the first terminal of the first switch;

a second capacitor having a first terminal coupled to the cathode of the diode and a second terminal coupled to the common ground;

voltage divider means, coupled between the cathode of the diode and the common ground, for supplying a feedback voltage representative of a voltage impressed across the second capacitor;

an oscillator having an output with selectable first and second frequency;

power inverter means, coupled between the cathode of the diode and the common ground and being controlled by the output of the oscillator, for chopping the voltage impressed across the second capacitor; and, detection circuit means, coupled to the first switch, for opening the first switch thereby reducing power to the second capacitor in response to a predetermined feedback voltage condition.

* * * * *